United States Patent [19]

Glassco et al.

[11] Patent Number: 4,879,850

[45] Date of Patent: Nov. 14, 1989

[54] MODULAR BUILDING CONSTRUCTION AND METHOD OF BUILDING ASSEMBLY

[75] Inventors: Robert B. Glassco, Pasadena, Calif.; Robert L. Noble, Carrollton, Tex.

[73] Assignee: Mansion Industries, Inc., City of Industry, Calif.

[21] Appl. No.: 188,834

[22] Filed: May 2, 1988

Related U.S. Application Data

[63] Continuation of Ser. No. 797,668, Nov. 13, 1985, Pat. No. 4,748,777.

[51] Int. Cl.[4] ..... E04C 2/16

[52] U.S. Cl. ..... 52/82; 52/90; 52/234; 52/417; 52/284

[58] Field of Search ..... 52/90, 92, 82, 234, 52/417

[56] References Cited

U.S. PATENT DOCUMENTS

| | | | |
|---|---|---|---|
| 591,611 | 10/1897 | Stran | 52/90 |
| 1,454,110 | 5/1923 | Feuillette | 52/90 |
| 2,585,051 | 2/1952 | Simon | 52/90 |
| 2,746,891 | 5/1956 | Doane | 52/417 |
| 2,896,271 | 7/1959 | Kloote | 52/417 |
| 2,982,054 | 5/1961 | Anderson | 52/82 |
| 3,203,145 | 8/1965 | Raynes | 52/234 |
| 3,445,970 | 5/1969 | Nelson | 52/82 |
| 4,012,871 | 3/1977 | Netto | 52/90 |
| 4,441,286 | 4/1984 | Skvaril | 52/234 |
| 4,672,779 | 6/1987 | Boyd | 52/82 |

FOREIGN PATENT DOCUMENTS

| | | | |
|---|---|---|---|
| 563849 | 9/1958 | Canada | 52/90 |
| 1359177 | 3/1964 | France | 52/90 |
| 188185 | 11/1922 | United Kingdom . | |

OTHER PUBLICATIONS

Author unknown; "Building Products 3", a catalog, published by Tetratech Systems, International Ltd., 9 pages.

"Stramit International Modular Housing Type M-2B", a catalog, published by Stramit International Ltd. (Suffolk, England), 7 pages (unpaginated).

Author unknown; "Stramit Boards Ltd. Technical Information Sheets" a manual, published by Stramit Corp. (Alberta) Ltd., Innisfail, Alberta, Canada, 119 pages (unpaginated).

Author unknown; "Stramit", a manual, published by Stramit Corp. Corporation Limited, date unknown, 74 pages (not paginated in a single series).

*Primary Examiner*—John E. Murtagh

*Attorney, Agent, or Firm*—William W. Haefliger

[57] ABSTRACT

A plurality of panels of strawboard are erected in a closed figure, preferably a square, on a foundation and their base edges mechanically secured to the foundation. The side edges of the panels are butted together and joined, for instance using tape and adhesive on both faces. A wall cap of novel construction is mounted to the upper edges, and a hip roof, preferably of pyramidal figure and made of corresponding cut panels of like strawboard are fitted in place. The foot of each roof panel fits in the wall cap, and its upper edge typically forms a definition line of the roof hip. The roof panels are similarly united using a tape and adhesive joint. Other types of roofs may be provided but are not presently preferred. In instances where strawboard is available in lesser thicknesses, multiple thicknesses of such thinner material, may be laminated to provide panels which are 4, 6 or more inches in thickness. Suitable ways of providing doors, windows, skylights, utility service and finishing are described, as are multiple-module buildings and preferred constructional techniques.

27 Claims, 9 Drawing Sheets

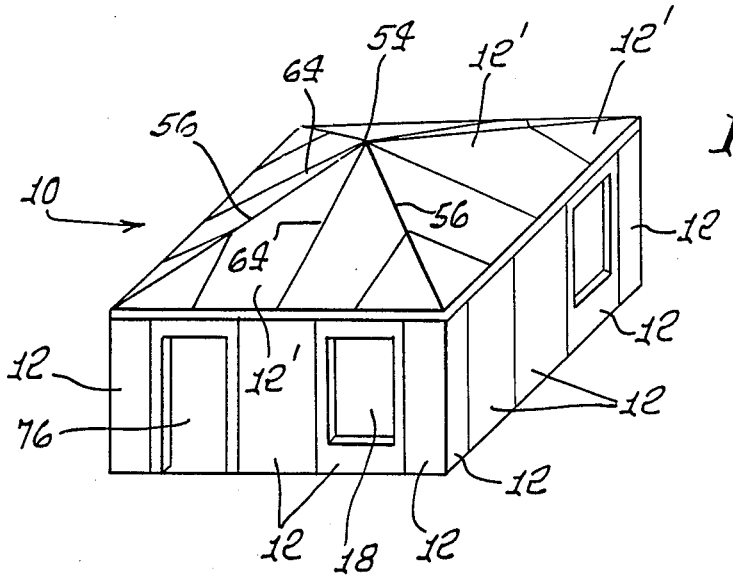
FIG. 1.
FIG. 2.
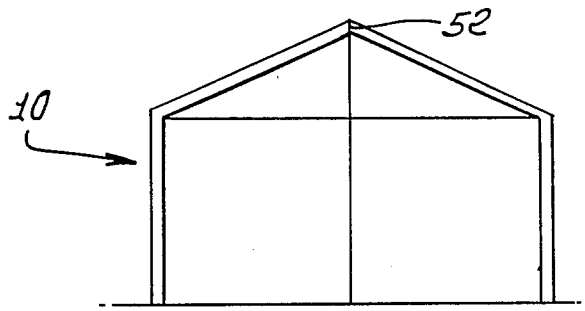
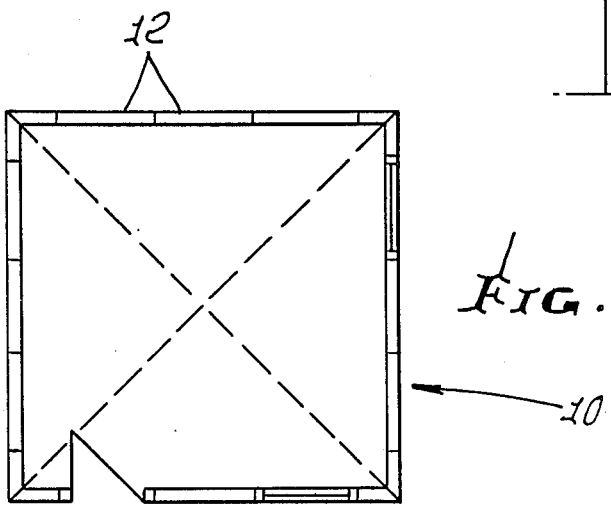
FIG. 3.
FIG. 4.
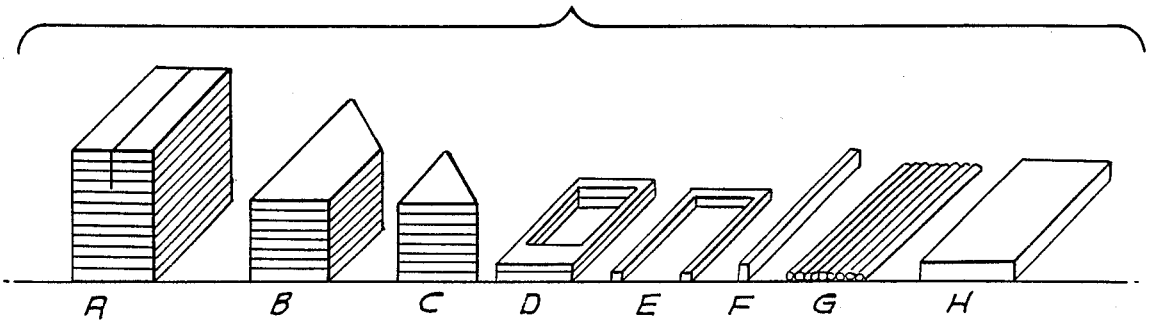

FIG. 13.
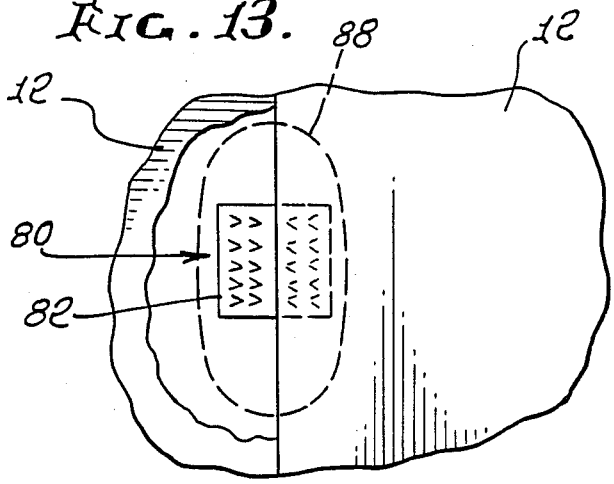
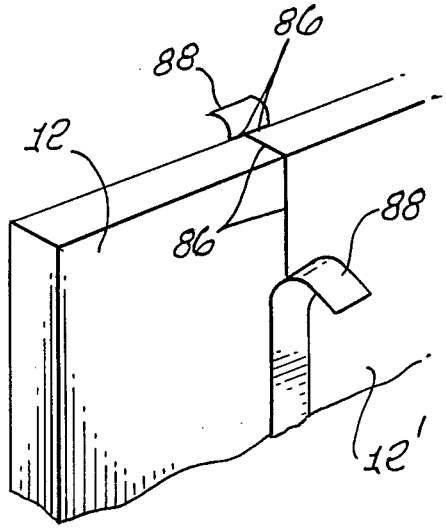
FIG. 14.
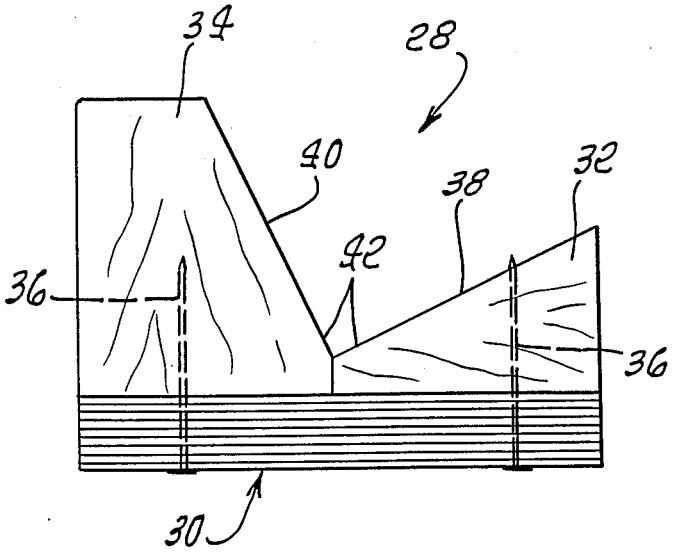
FIG. 15.
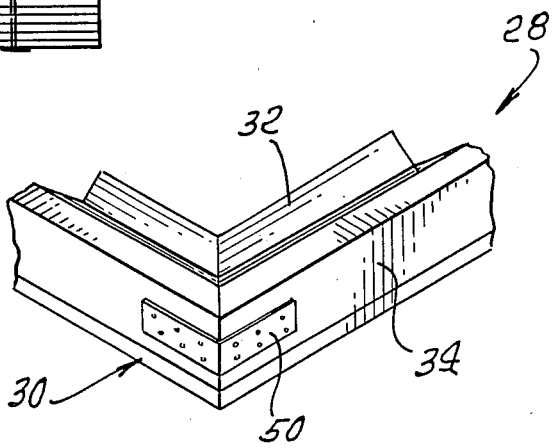
FIG. 16.

MODULAR BUILDING CONSTRUCTION AND METHOD OF BUILDING ASSEMBLY

This is a continuation of application Ser. No. 797,668, filed Nov. 13, 1985, now U.S. Pat. No. 4,748,777.

BACKGROUND OF THE INVENTION

The present invention relates to ways and means for building buildings predominately out of straw, and in particular to such buildings in which panels of compressed straw are united to serve not only a space-filling function, but also a load bearing function, so that the need for a building framework or skeleton whether internal to or external to the panelling is largely eliminated.

Building shelters, habitations and storage structures largely or partly of straw is a concept with an origin that predates recorded history. Straw/mud mixtures were used in the manufacture of sun-baked building brick in the Egypt of the pharaohs; to this day straw is used for thatching of roofs and/or walls in housing of indigenous, traditional design in parts of the Soviet Union, Africa, Japan, Iraq, Great Britain, and elsewhere.

The use of straw as an ingredient in modern, engineered construction of buildings probably dates from about 1930, with the invention of paper-faced construction panels of compressed, heat-treated strawboard by Niels Ryberg, in Sweden.

One company, now headquartered in Great Britain, but having many subsidiaries, affiliates or licensees in various countries, Stramit International, Ltd., of Creeting Rd., Stowmarket, Suffolk, England (also Stramit Corporation Limited, of Edmonton, Alberta, Canada), must be acknowledged to have been one of the earliest producers of such strawboard, under the trademark Stramit, and the literature which they have produced continues to be a valuable fund of background information about the physical characteristics of such strawboard and techniques and accessories useful for incorporating such strawboard in buildings. Another provider of such strawboard for use in construction of buildings is Tetratech Systems International, Ltd., which calls its product Tetraboard.

A way for making strawboard that is useful in the building architecture of the present invention, including detailed descriptions of physical characteristics of a preferred, suitable strawboard, is disclosed in the U.S. patent of Dvorak, U.S. Pat. No. 4,451,322, issued May 29, 1984, the entire disclosure of which is incorporated by reference herein.

To the knowledge of the present inventors in prior art uses of strawboard in the construction of buildings, the individual panels of strawboard have been used, whether singly, or with jointed construction, to fill the facial area between adjoining posts, beams, rafters, joists and similar elements of a separate (and heretofore believed necessary) structural frame or skeleton of a building. For instance, Stramit product literature describes use of its strawboard as panels for roof decking, roof insulation, interior wall lining, ceilings, and partitions, both fixed and movable. Tetratech product literature describes use of its strawboard as panels for these same uses, and as exterior sheeting, in fill panels, subflooring, sound attenuating panels, acoustical baffles and in the fabrication of doors. Probably because the aforementioned patent of Dvorak is concerned with apparatus for making strawboard, it does not contain an extensive description of uses for the strawboard other than mentioning that it is an architectural structural material that is versatile, durable, relatively inexpensive, and of considerable utility in the construction of dwellings and other buildings, in which it may serve as a ceiling or wall board, as a thermally insulative layer or as a material useful in acoustic absorption or isolation.

Some older Stramit product literature discloses the use of a strawboard in the construction of the walls and roof of a temporary bunkhouse. Recent Stramit product literature discloses use of strawboard in the construction of modular housing. In all of these instances either the strawboard is disclosed to be used for plating a balloon frame made of wood and/or fabricated sheet metal framing elements and/or to make use of metal structural framing elements built-into the strawboard panels, e.g. as U-shaped sheet metal channels clamped around the edge margins of the individual strawboard panels. In erecting a structure using such panels, mechanical connections are made between the metal channels of adjoining panels, thus connecting the panels together while simultaneously erecting a supporting framework.

The present inventors believe they have devised an invention which radically differs from the prior art described above, in that it calls for uniting panels of strawboard into a structural membrane, providing a building with substantially less use of any framing, so that all loading is primarily born and distributed by the relatively homogeneous strawboard, much as if it were an igloo made of strawboard and adhesive, rather than of snow and ice.

For those who are not familiar with the characteristics of strawboard such as that which may be used in practicing the present invention, a brief description will be provided here, although for more extensive information, the interested reader will certainly wish to consult the available literature.

In manufacturing strawboard, a suitable straw, of the same sort which is traditionally used as roughage and bedding for cattle, horses, sheep and the like, e.g. including any proportions of dry (typically less than 15 percent moist, by weight) stalks of the cereals (such as rice, wheat, rye, oats and barley), grasses, sugar cane bagasse is cleaned of foreign matter such as stones and clods of soil, as well as of fine particles and dust, and is fed at a uniform rate and well-distributed manner into the ram of an extruder, where it is shaped, compressed and baked, at a temperature of about 350°–400° F., continuously emerging as a billet of indeterminate length a uniform thickness and width. Two, three and four inches are desirable thicknesses, and four feet is a standard width. The emerging board is typically golden in color. No adhesive generally is needed for sufficiently unifying the bulk of the board, since, during the extrusion process, natural constituents of the straw, such as lignins which typically make-up from about 10 to about 30 percent of its weight become activated and naturally adhere the constituents of the board together. Additional glue could be added as the straw is being fed to the extruder, as is done in the manufacture of particle board, but presently such is not thought to be necessary, and is not preferred. The same holds true for additions of anti-fungal agents, anti-bacterial agents, mold-inhibiters, rodenticides and the like, either as ingredients or as coatings.

Due to the action of the ram of the extruder, the grain of the bulk of the board typically runs crosswise and thicknesswise, although there are fiber interconnections running in all directions.

The emerging board preferably is wrapped first on one face and both edges, then on the other face and overlapping both edges, with paper, which may be any of the same types of paper as are commonly used for wrapping the pores of gypsum or foamed plastic wallboard. However, in the instance of strawboard manufacture, no attempt is made to particularly or significantly prestress the skin of the product e.g. by maintaining the paper under strong tension as it is adhered in place. Gray liner paper or brown Kraft paper, pre-sized as for painting and typically up to 0.06 inch thick is used as the covering of the core of the board, this covering being adhered in place using a suitable adhesive, e.g. urea-formaldehyde thermosetting resin adhesive.

After the continuous board is so covered, typically it is cut crosswise into sections of desired length, e.g. into panels each eight feet in length. Cut ends are covered by similar paper strips, similarly adhered in place.

The resulting panels have a density of about 16 to about 23 pounds per cubic foot and a modulus of elasticity of about 17,500–21,500 p.s.i., e.g. for a 3 inch thick panel. Such a panel typically has a longitudinal crushing failure (on a uniformly-loaded cross-section that is 47.25 inches wide and three inches thick, and a board density of 16.0 pounds/cubic foot at the beginning of the test), of approximately 6000 pounds, column failure of an eight foot tall panel of the same size and constituency typically being approximately half that figure.

Although unconsolidated natural straw is notoriously combustible and a fire hazard, strawboard of the type described herein chars when subjected to torching, but does not support combustion and generally self-extinguishes upon withdrawal of the torch. However, the paper covering can be combustible and a means for spreading flame, so, for meeting noncombustible construction requirements, it may be necessary to use covering paper which has been treated with a suitable flame retardant or the like.

Typically, the strawboard gains only one-thousandth in linear dimension upon being raised in ambient humidity from 40 to 90 percent. However, such strawboard is not itself waterproof and must be suitably protected if it is to endure a moist environment.

SUMMARY OF THE INVENTION

A plurality of panels of strawboard are erected in a closed figure, preferably a square, on a foundation and their base edges mechanically secured to the foundation. The side edges of the panels are butted together and joined, for instance using tape and adhesive on both faces. A wall cap of novel construction is mounted to the upper edges, and a hip roof, preferably of pyramidal figure and made of corresponding cut panels of like strawboard are fitted in place. The foot of each roof panel fits in the wall cap, and its upper edge typically forms a definition line of the roof hip. The roof panels are similarly united using a tape and adhesive joint. Other types of roofs may be provided but are not presently preferred. In instances where strawboard is available in lesser thicknesses, multiple thicknesses of such thinner material, may be laminated to provide panels which are 4, 6 or more inches in thickness. Suitable ways of providing doors, windows, skylights, utility service and finishing are described, as are multiple-module buildings and preferred constructional techniques.

The principles of the invention will be further discussed with reference to the drawings wherein (a) preferred embodiments are shown. The specifics illustrated in the drawings are intended to exemplify, rather than limit, aspects of the invention as defined in the claims.

BRIEF DESCRIPTION OF THE DRAWINGS

In the Drawings

FIG. 1 a diagrammatic perspective view of a single 16×16 foot building module constructed in accordance with principles of the present invention;

FIG. 2 is a vertical cross-sectional view thereof; and

FIG. 3 is a horizontal cross-sectional view thereof taken at mid-height on the sidewalls, but indicating the roof in dashed lines.

FIG. 4 is a diagrammatic perspective view of major components of a kit of parts for assembling the module of FIGS. 1–3.

FIG. 13 is a fragmentary elevational view showing how optional spline plates may be provided in the panel-to-panel wall joints;

FIG. 14 is a fragmentary perspective view illustrating uniting of panels where they abut on an edge, e.g. using fiberglass tape embedded in a mastic compound, on both sides of the wall;

FIG. 15 is a transverse cross-sectional view of the wall cap;

FIG. 16 is a fragmentary perspective view showing lengths of the wall cap stock mitered and joined, with reinforcement at the corners;

DETAILED DESCRIPTION

Figure 5:
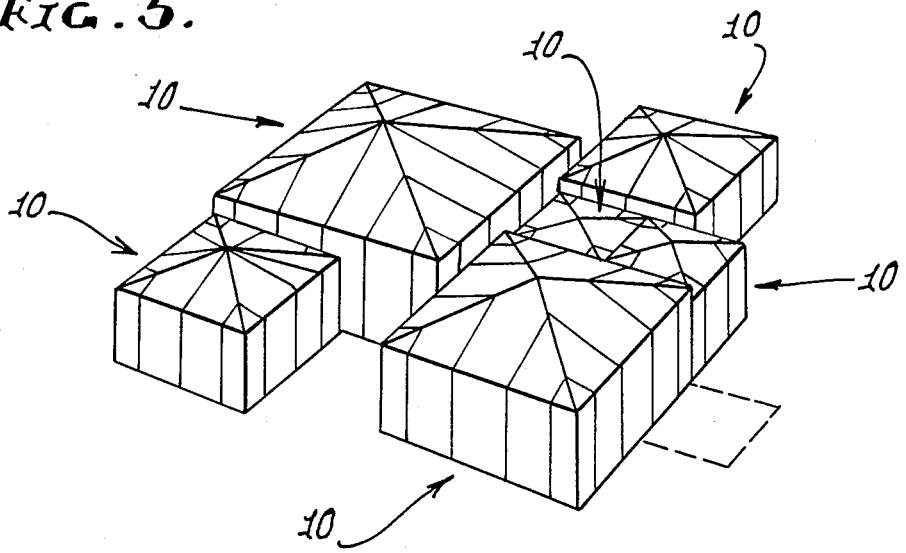
FIG. 5 is a diagrammatic perspective view showing a building made by assembling a plurality of different-sized ones of the modules.

The fundamental concept of the present invention is to bring to the construction of buildings, particularly but not exclusively housing, a substantially frameless, skeleton-less, monocoque type of construction, in which the "skin" is used not only for providing a membrane, but also as a sufficient load bearing structure.

Presently, it is preferred that the building modules 10 be fabricated of panels 12, each of which is made of strawboard made of the materials, by the process, and using the apparatus as has been briefly described in the introductory section hereof with reference to U.S. Pat. No. 4,451,322. Each panel 12 preferably is six inches thick, by four feet wide, by eight feet (or some other selected length) long. Primarily because the machinery currently available will not produce suitable strawboard which is six inches thick, the panels 12 are made by plating together, i.e. laminating, two thicknesses of three-inch thick strawboard, e.g. using the same type of adhesive that is used for adhering the paper 14 which covers the core of compressed, consolidated, heat-treated straw 16 the exterior of that core. Other thicknesses are possible, e.g. a three-inch thick board, used alone; or two two-inch thick boards laminated to produce a four inch board; or a four-inch thick board, used alone; or a three-inch thick board laminated to a two-inch thick board. The first step in assembling a module 10 is the providing of a sill 20 on a foundation 22, e.g. a concrete slab. It may be convenient to supply the materials for a module to the job site in kit form. Referring briefly to FIG. 4, a kit of parts for fabricating a 16×16 foot module in a preferred practice of the present invention may include:

PARTS LIST

Shown:

A. 9 six inch thick 4′×8′ Mansion board wall panels & 8 six inch thick 2′×8′ Mansion board corner wall panels
B. 8 six inch thick center roof panels
C. 8 six inch thick corner roof panels
D. 2 six inch thick wood window wall panels w/rough openings
E. 1 six inch thick wood door wall panel w/rough opening
F. 64 linear feet of 2×6 sill plate
G. 64 linear feet of prefabricated composite wall cap
H. 4′×8′ sheets of 7/16″ waferboard sheathing for 287 sq. ft. roof Not Shown:

One door unit, two window units, 18 gauge galvanized flashing for foundation perimeter, four 16 gauge galvanized corner the brackets for wall cap corners, 6d galvanized nails, 16d galvanized nails, 5½″ barn nails, 10½″ barn nails, 4″ fiberglass tape, 6″ fiberglass tape & a supply of mastic adhesive (At some places in the text and drawings as filed, the term Mansion board is used; Mansion is a trademark of the assignee for its brand of strawboard.)

A typical sill 20 is provided by conventionally securing to the foundation a plate of nominally 2×6 inch lumber, arranged according to the plan of the module (e.g. in a square, sixteen feet on a side). On both or at least one (e.g. the exterior) side of the sill 20, strapping 24 is secured to the sill to bring the sill out to full thickness compared to the panels, and to provide a ledge 26 which protrudes upwards slightly above the sill in order to define with the sill a channel for receiving the lower edges of the wall panels 12. The wall panels 12 are then erected, starting with a corner, or elsewhere. The wall panels are each seated on the sill channel, and butted edge-to-edge. Along the top, panels 12 are united by supporting a wall cap 28 on them, and securing each wall panel 12 to it.

The wall cap 28 is preferably supplied as a prefabricated composite structure, in lengths, each being longer than the width of a panel, e.g. eight lengths each eight feet long.

Figure 17:
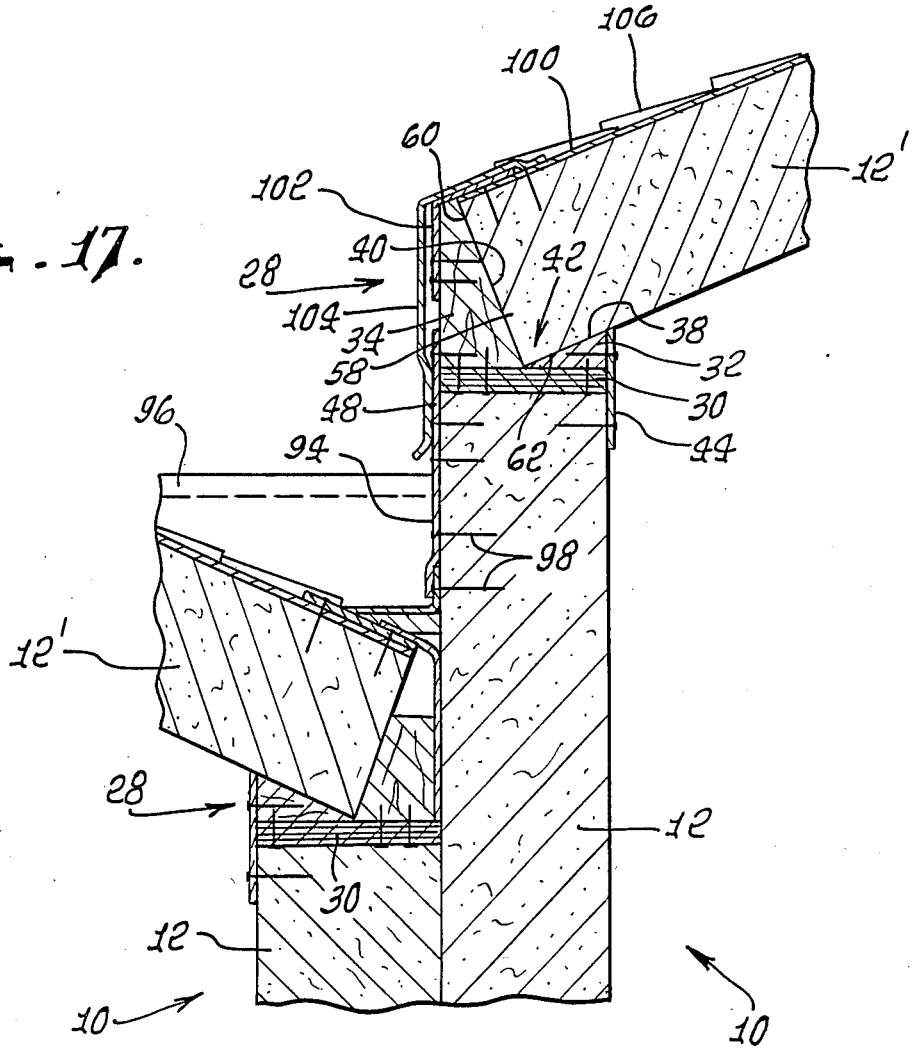
FIG. 17 is a fragmentary vertical sectional view showing wall cap and cricket details at a place where two similar modules, of differing sidewall height adjoin.

Referring briefly to FIG. 17, each length of prefabricated wall cap 28 is shown comprising a base 30 constituted by a strip of plywood, waferboard or the like, e.g. equal in width to the thickness of a panel 12 (e.g. six inches wide) and e.g. three-fourths of an inch thick. On this base are secured an inner block 32 and an outer block 34, e.g. by dry wall screws or nails 36. The blocks 32 and 34 are each as long as the base 30 and may be ripped from the same piece of standard lumber, e.g. a 2×4, with their upper and rear surfaces, respectively, 38 and 40 canted to complement the undersides and lower ends of the roof panels 12′. Thus, the blocks 32 and 34 serve as cant strips for the wall cap, while the base 30 serves the sidewall of the module. The surfaces 38, 40 between them define a groove or channel 42, for which the block 34 serves as a foot or stop.

The lengths of wall cap are shown secured to the panels 12 by plating strips of wood or metal 44, 48 over the intersections and nailing into the panels along their upper margins, and into the respective cant strips, e.g. using 16d nails. Although corner tie plates 50 are secured to the wall cap sections at the corners, this is primarily for aligning and uniting the sections of the wall cap, and for facilitating the construction process, than for uniting the panels 12.

If wall panels 12 of half-width (produced by sawing and adhesively taping the cut edge of a 4×8 foot panel) are used at the corners, as shown in FIG. 1, the joints of wall cap sections will not coincide with joints between wall panels. However, this is presently not believed to be an essential constructional detail.

Once the tops of the wall panels 12 have been secured to the wall cap, and the sections of the wall cap have been tied to one another at the corners by means of plates 50, the roof panels 12′ may be installed.

By preference, all of the roof panels 12′ are pre-sawn along their upper edges 52 at a proper compound angle so that the upper ends will come to a peak (which is a point 54 for a pyramidal roof), and abut those of an adjoining side of the module along a hip line 56 of the roof. A presently preferred pitch to the roof is 22.5 degrees declination from horizontal. First, more medial panels which will meet at the peak on the various sides of the module are lifted into place, their lower edge margins 58 seated in the wall cap channel 42, their lower ends 60 against the stop block 34 their underside 62 against the canted surface of the inner strip 32, and their upper ends propped together at the peak 54. Then, the more lateral roof panels 12′, i.e. the ones closer to the corners are similarly installed. (It is preferred that the roof panels 12′ be laid out so that, where possible, seams 64 between adjoining panels meet at the apex 54. The fitting of the panels 12′ into place is thereby facilitated.)

Figure 18:
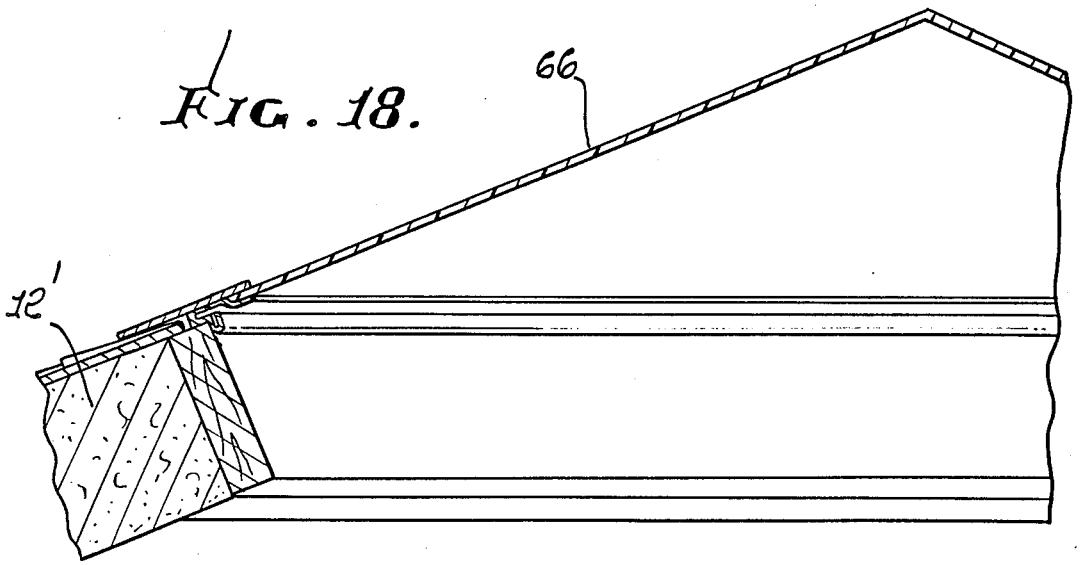
FIG. 18 is a fragmentary vertical sectional view showing an optional peak skylight.
Figure 19:
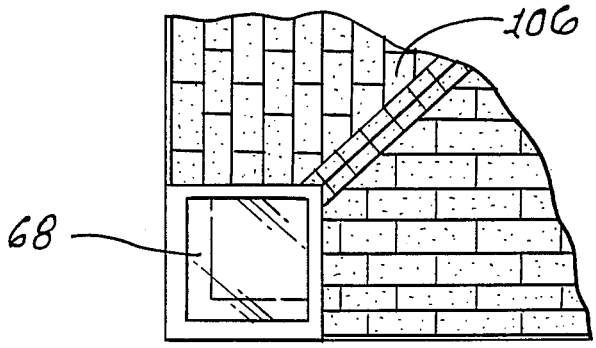
FIG. 19 is a fragmentary top plan view of the roof of a module showing an optional corner skylight.
Figure 20:
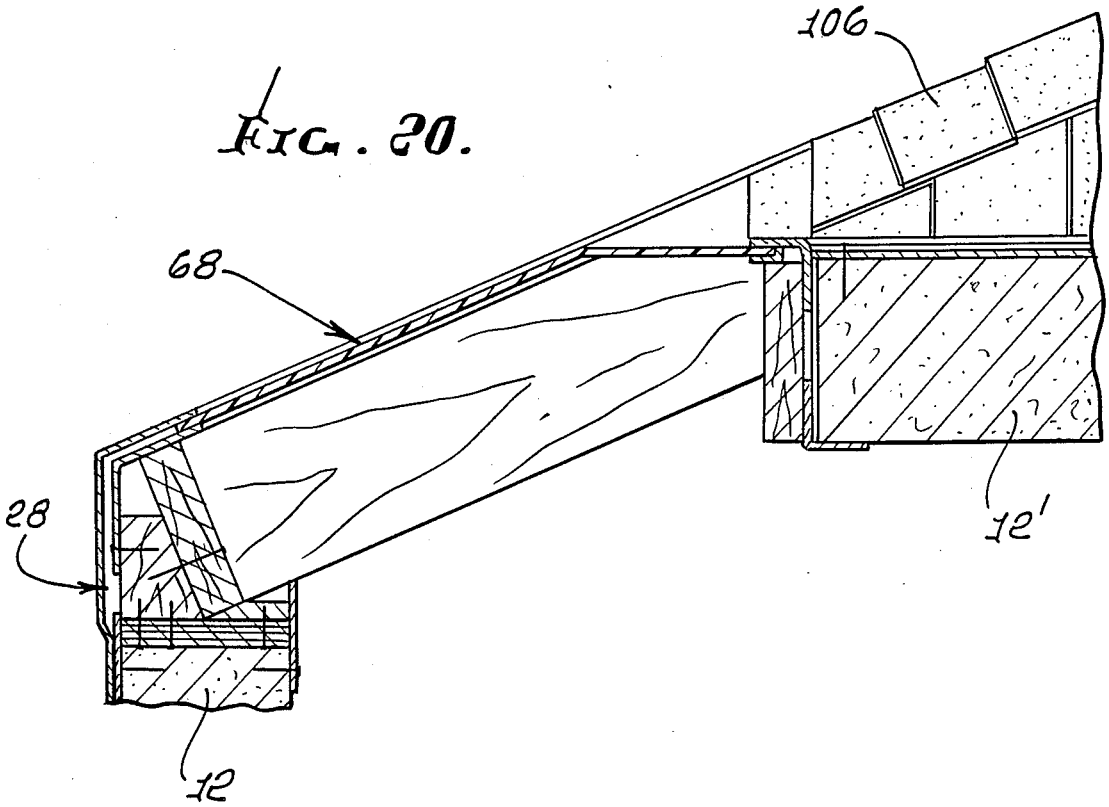
FIG. 20 is a fragmentary vertical sectional view showing details of the optional corner skylight of FIG. 19.

Referring briefly to FIGS. 18–20, corresponding portions of panels 12′ may be cut away, either as the parts for the module 10 are being constructed, or at the job site, so that a peak skylight 66, as shown in FIG. 18 may be installed, e.g. using such techniques and details as are there illustrated, and/or so that one or more corner skylights 68, as shown in FIGS. 19 and 20 may be installed, e.g. using such techniques and details as are there illustrated.

Figure 9:
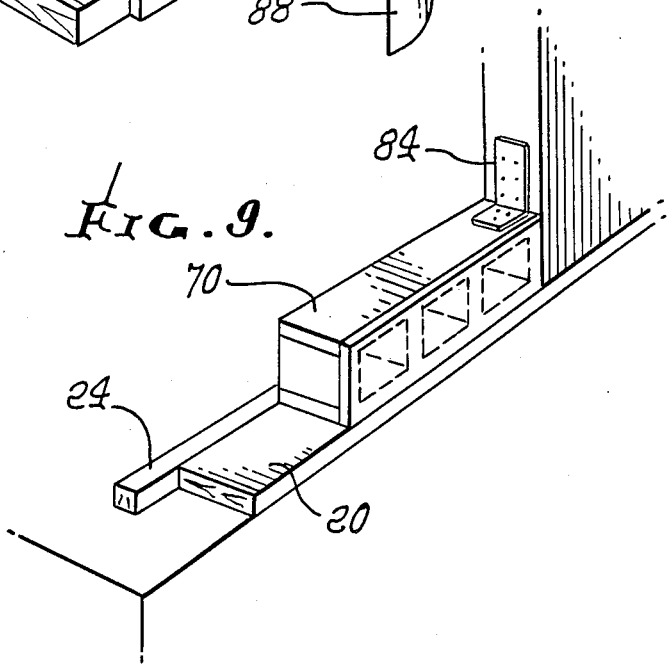
FIG. 9 is a fragmentary perspective view illustrating one stage of incorporating an access frame for utility service into the base of the sidewall of a module.
Figure 10:
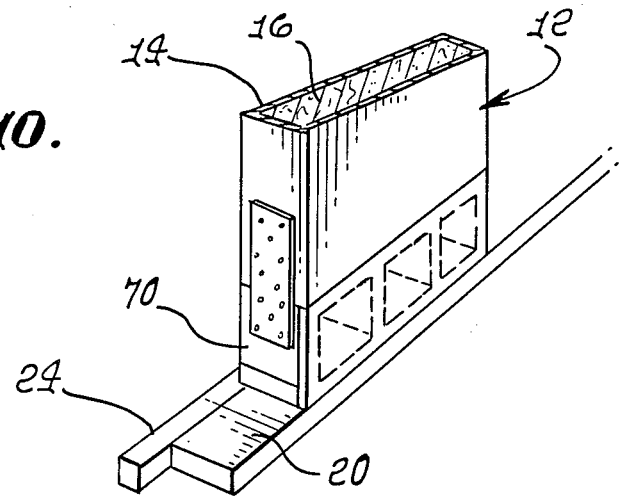
FIG. 10 is a similar view at a later stage.
Figure 11:
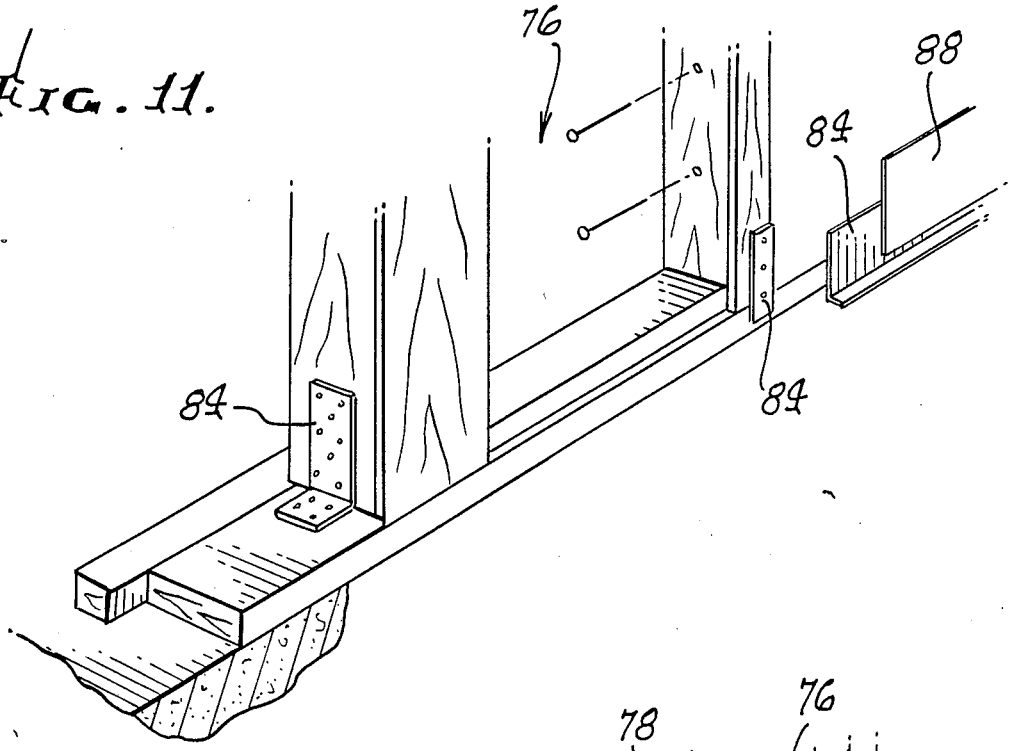
FIG. 11 is a fragmentary perspective view showing installation of a door panel.
Figure 12:
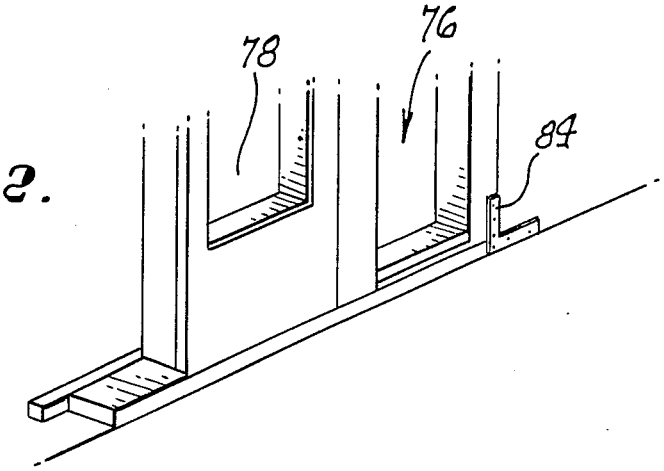
FIG. 12 is a fragmentary perspective view showing installation of a window panel.
Figure 21:
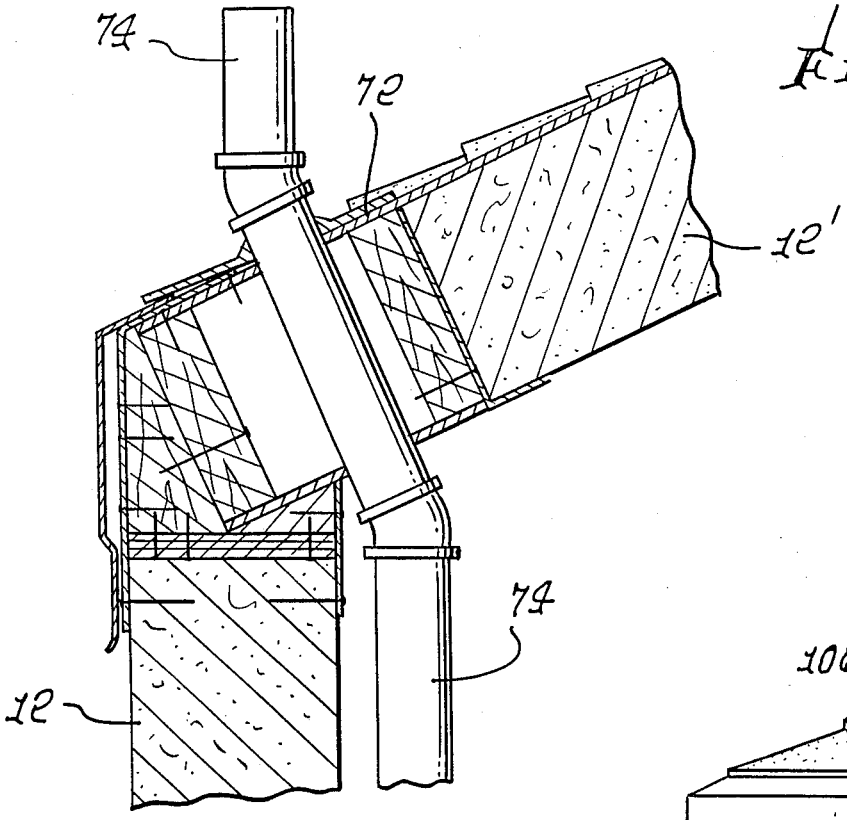
FIG. 21 is a fragmentary vertical sectional view showing a vent stuck emerging through an access frame.

In fact, for any departure from uniformity needed for installation of a particular feature, whether it is the need for intersection with upper edges of other roof panels 12' along roof hip lines, or for accommodating skylights, as has just been described, or for providing an access frame 70 for utility service through a wall panel 12 (as illustrated in FIGS. 9 and 10), or for providing an access frame 72 for emergence of a vent stack 74 through a roof panel 12' (as illustrated in FIG. 21), or for providing an opening 76 medially placed in a wall panel 12 and contiguous with its lower edge for a door frame (as illustrated in FIG. 11), or for providing an opening 78 centrally through a wall panel 12, and spaced from all of its edges for a window frame (as illustrated in FIG. 12) for mitering wall panel side edges at module corners, or for other, similar purposes, the cutting may be done as pre-cutting at the panel factory or module kit marshalling site, or in the field, at the job site. In either case, any panel cutting preferably is done using a sharp-bladed saber saw, and the cut edges preferably are "healed" using mastic or other adhesive and tape, such as that used for covering the cut ends of the panels 12 at the panel manufacturing site. This covering may be applied to the cut edge before the respective panel is juxtaposed with others, or (at the job site) it can be applied as a bridge between two panels or between a panel and other structure after the respective panel has been incorporated into the module.

Although it is not presently preferred, in instances where it is desired, abutted panels may be mechanically joined at one or more local sites along their edges, e.g. by using a sharp-bladed rotary saw to cut a kerf or rabbet in each at a corresponding intermediate level and depth, as shown at 80 in FIG. 13, and jam-fit a spline plate 82 to half its own depth in each of the slots 80.

Various strips, plates and the like 84, whether straight or angled may be nailed in place as illustrated for mechanically tying panels to one another or to other structures at boundaries. By preference, use of such ties is kept to a minimum. Similarly, nails and screws may be used, as generally illustrated throughout, for tying various elements together.

The presently preferred material for covering all joints on both faces between abutting edges of adjoining panels 12, 12' and between such panels and other elements, where illustrated, is a combination of a joint filler 86 or crack filler that is plastic and adhesive e.g. a polyester mastic, and a tape 88, e.g. of fiberglass scrim cloth which will stick to the mastic. Where a joint is accessible from both sides, on each side the filler 86 is squeezed as a bead or troweled into place so that it infiltrates the joint preferably to a depth of about one-half inch in from the face through which it is applied and covers the faces of the elements to be joined, to a width approximating the width of the tape. A length of tape 88 is then unrolled into place covering the juncture and pressed flat. Typical tape width is four inches, although broader or narrower tape could be used. Where the tape 88 is foraminous, more mastic may be applied over the tape and the covered joint smoothed with a suitable tool such as a trowel. The tape-covering substance may be different than the joint filler 86, e.g. it may be a conventional joint compound used for covering panel-to-panel joints and recessed drywall screwheads in conventional drywall construction. Although it is no generally preferred, that same type of feathered and/or perforated paper tape as is used in conventional drywalling can be used as the tape 88. However, fiberglass scrim and polyester mastic are preferred. A suitable product is available under the tradename Tuffglass faboric for use with Krack-Kote mastic, both from Tuff-Kote Co., Inc. of Woodstock, Ill. Comparable products are available from other manufacturers formulated both for interior and for exterior use, and may be used in accordance with their manufacturer's instructions.

What is important is that at the panel-to-panel abutment joints, the mechanical bridges which are formed by the mastic and tape should unify the panels into a unitary diaphragm, membrane or the like much as does the ice between blocks of an igloo, but without imposing a stiffness that would detract significantly from the substantial homogeneity of the unified wall panels. If the walls and roof could be made of one integral, seamless panel, that would be considered ideal, but seeing that such is impossible, the function of the preferred mastic/tape joint connections is to cause the resulting unified panel structure to behave statically and dynamically as close to that ideal as can be readily and repeatedly achieved using multiple panels of finite extent, as has been described.

Figure 6:
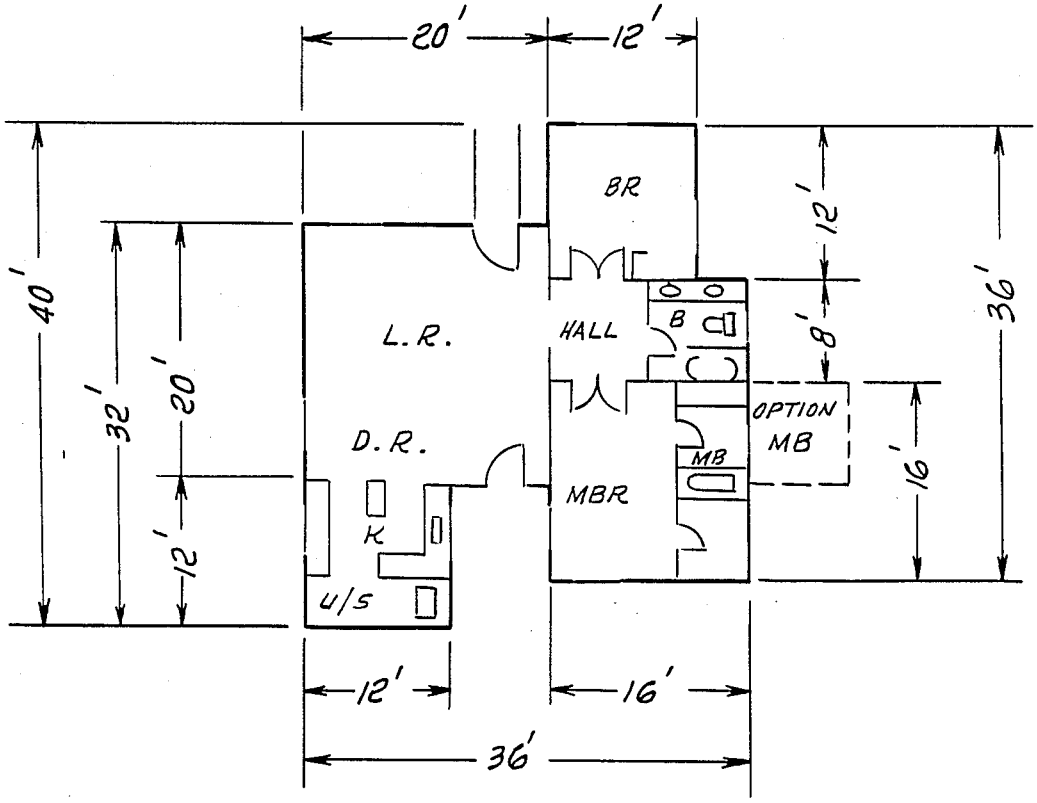
FIG. 6 is a typical floor plan of the building of FIG. 5.
Figure 7:
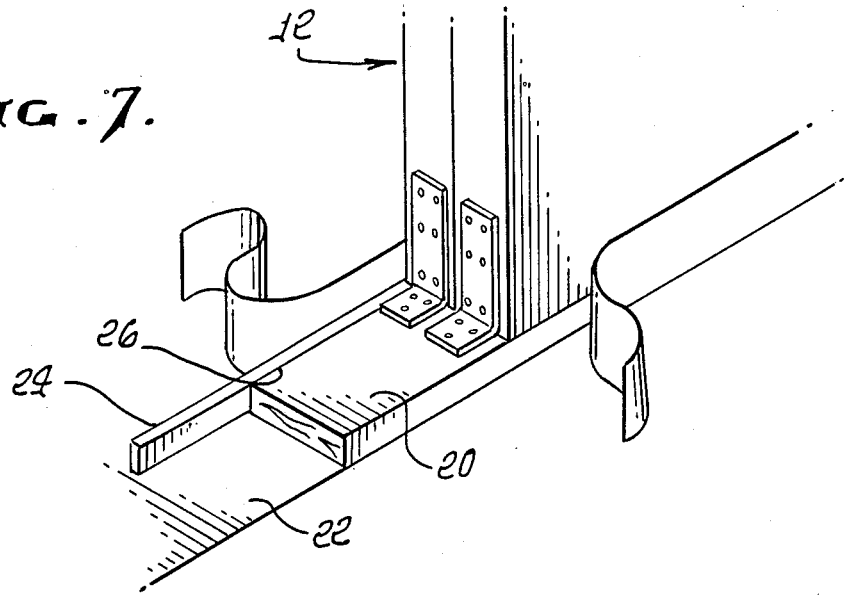
FIG. 7 is a fragmentary perspective view showing typical panel/sill joinery details for a single module.
Figure 8:
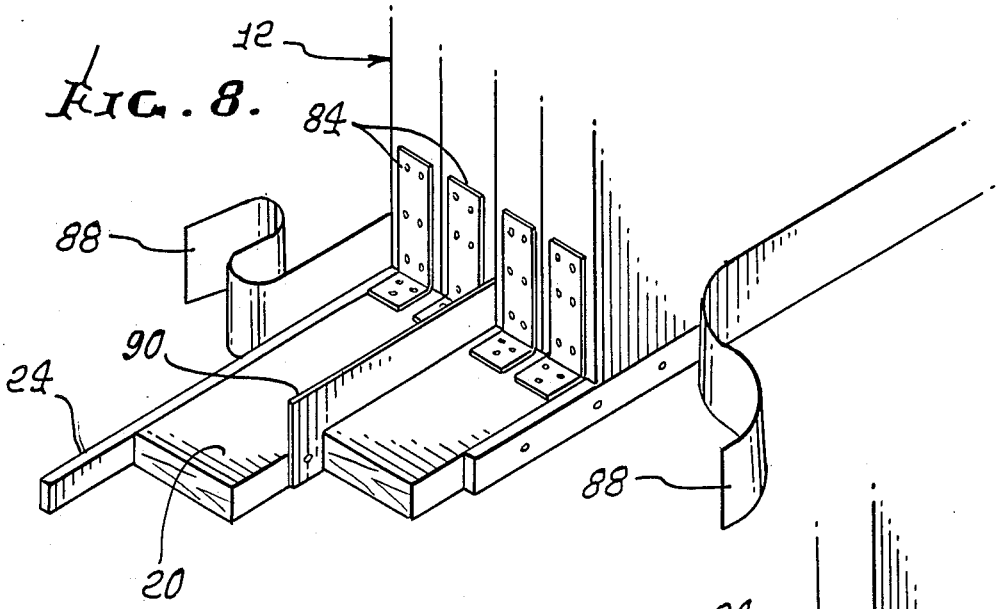
FIG. 8 is a similar view of such details for use where two modules adjoin.

Although single-module buildings consisting of one module 10 are within the contemplated scope of the invention, many if not most buildings, whether or not they included other structural components or features, would include two or more modules 10, juxtaposed in facially abutting relation along at least part of at least one sidewall of each, e.g. as shown in FIGS. 5 and 6. In such cases, adjoining modules, where they adjoin, preferably do not share a common wall as a party wall, but rather the two modules are built in close juxtaposition much as they would be were they each being built in different places, except that the juxtaposition may make some joints of at least part of one face of one wall inaccessible for taping, and intermodular connections may advantageously be made base, e.g. by strapping 90 nailed to the sill plate of one and to the panelling of the other (as shown in FIG. 8) and at 92 along the wall caps, (as shown in FIG. 17).

In FIG. 17, a typical situation is illustrated, in which two adjoining modules 10 have different heights, so that the cricket and flashing 94, 96 on the roof of the lower one (at the left) are tied into the sidewall panelling 12 of the other (at the right), at a level that is intermediate and adjacent to the respective wall caps, e.g. using nails 98.

Figure 22:
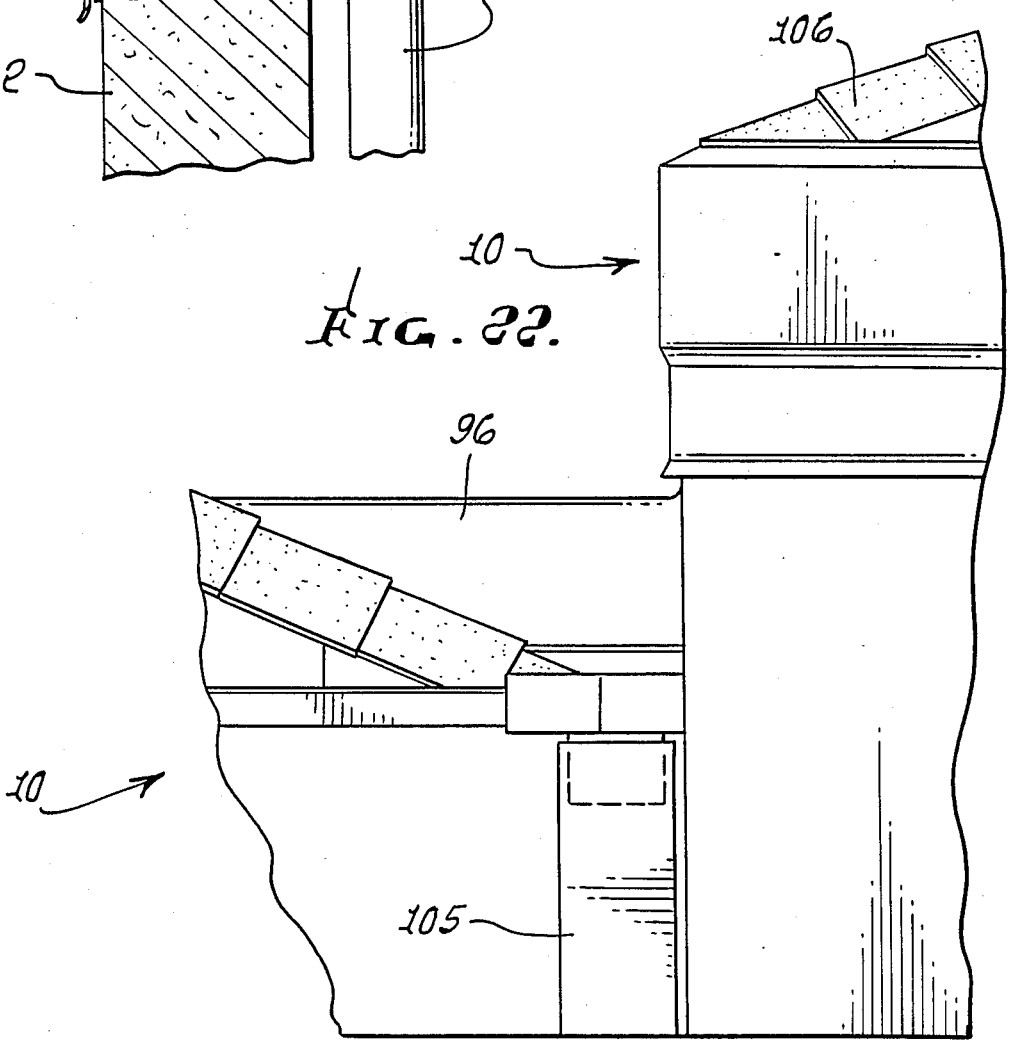
FIG. 22 is a fragmentary elevational view corresponding to FIG. 17 showing cricket and downspout details.

The roof panels may be further protected by plating the unitary diaphragm thereof with an all-over layer 100 of three-eighths inch thick plywood or the like, which may be glued and or nailed in place or otherwise secured. A sheet metal eave connection 102 fills the corner and is mechanically connected e.g. by nails between the upper surface of the plywood-plated unitized roof panel diaphragm and the outer surface of the exterior cant strip of the wall cap. A sheet metal facia 104 similarly is secured on the upper side of the lower margin of the plywood-plated roof panel assembly, and extends down over the flashing 96, where it would otherwise be exposed. Where necessary, guttering as well as cricketing together with downspouts 105 (FIG. 22) may be provided, e.g. as typically shown, and roofing 106 such as shingling may be applied in a generally conventional manner.

Doors and windows of conventional construction may be mounted in the openings made for them using generally conventional techniques. The buildings may be further finished, as desired. In regions subject to rainfall or other moist conditions, inasmuch as the panels 12 are not waterproof, further finishing will necessarily include coating exteriorly exposed surfaces of the diaphragm with paint, vapor barrier, bitumen, exterior-grade gypsum plaster, waterproofing compound, metal mesh lath and stucco, shingling and/or the like, using largely or wholly conventional techniques and materials.

A typical housing construction program using modules of the present invention may, for example, be based on standard four-foot increments of panel width, much as rooms of traditional Japanese houses are scaled on the basis of standard-sized tatami floor mats. In such a case, a 20×20 foot module (5 panels in width), may be used as a complete studio unit, a combined living-/dining/kitchen space, a combined living/dining space, a living room, a large family room, or a garage. A 16×16 foot module (4 panels in width), may be used as a small living room, a family/recreation room, a master bedroom/bath, a master bedroom, or a large study/library. A 12×12 foot module (3 panels in width), may be used as a dining room, a kitchen/pantry/laundry space, a small family room, a master bath, a small bedroom with closets, a small study/library or an entry hall. An 8×8 foot module (2 panels in width), may be used as a master bath, a bath/closet/storage space, a pantry/laundry space, a utility/mechanical room space, a laundry room/closet space, a walk-in closet, an interior hall, or an entry hall. There are other possibilities, and all permutations and combinations of modules juxtaposed and clustered in ones, twos, threes and more, can be used. FIGS. 5 and 6 illustrate but one of many of these. Typically within each module, although dividing walls and ceilings for spaces thus walled off, e.g. for closets and bathrooms may be provided, the remainder of the interior space is open to the underside of the hipped roof i.e. has a "cathedral" ceiling. Conventional interior finishes such as paint and wallpaper may be used for decorating the various spaces within the building.

It should now be apparent that the modular building construction and method of building assembly as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A modular building, comprising:

(a) four upright walks together forming an enclosure, each of the walls including a succession of upright panels extending in a common plane, successive panels of each wall having upright lateral edges which are joined together in edge-abutting relation at joints formed therebetween, only the said panels defining the said building four walls, certain of said panels joined together to form vertical corners of the enclosure, (b) the wall panels having uppermost edges which extend horizontally in a common horizontal plane, (c) horizontally elongated support members with horizontal undersides mounted on and seated downwardly in flush engagement with said panel upper horizontal edges, said support members extending to and between said corners of the enclosure, each of said members having an upper support surface, the support member upper surfaces being located above said horizontal undersides of the support members, (d) a pyramid shaped roof extending over the enclosure and defined by four like roof sections spaced about a vertical axis intersecting a peak formed by a common intersection of the four roof sections, each section including at least two roof panels extending in a common plane inclined upwardly toward said peak, (e) said two roof panels of each section having:

(i) lower edge portions supported by a support member upper surface as defined, and (ii) first lateral edge portions joined together in edge abutting relation and extending upwardly generally toward said peak, (f) and the said roof panels of adjacent sections having second lateral edge portions joined together in edge abutting relation to support the sections laterally above the level of said plane defined by the support members, said second lateral edge portions located along lines extending diagonally from said corners to said peak, (g) all of said wall and roof panels consisting essentially of low-strength fibrous material in compacted state, to a density of about 16 to 23 pounds per cubic foot, and a modulus of elasticity of about 17,500 to 21,500 psi, and at least two inches of thickness, (h) adhesive mastic in said joints acting to bond successive wall panels together, (i) tape strips bonded to successive panels of each wall at and along said upright lateral edges thereof, at outer side surfaces of the panels adjacent said edges, and at inner side surfaces of the panels, thereby bridging said joints, (j) said tape strips comprising substantially the only joint overlapping interconnection of the panels, at and along the edges thereof, (k) successive roof panels also bonded together and connected together as are said successive wall panels, (l) said support members with said roof supported thereon providing a lateral stiffening means for restraining bowing of the tape and mastic interconnected wall panels.

2. The modular building of claim 1 including adhesive joining together said lateral edges of successive panels in each wall, in said edge abutting relation.

3. The modular building of claim 1 including adhesive joining together said first lateral edge portions of the two roof panels of each roof section, in said edge abutting relation.

4. The modular building of claim 1 wherein the wall panels including intermediate panels of relatively greater width and corner panels of relatively lesser width, and including tape strips bonded to and interconnecting successive roof panels, along said first lateral edge portions thereof.

5. The modular building of claim 1 including tape joining together said first lateral edge portions of the two roof panels of each roof section in edge abutting relation.

6. The modular building of claim 4 wherein said tape consists of fiber cloth.

7. The modular building of claim 5 wherein said tape consists of fiber cloth.

8. The modular building of claim 1 wherein at least some of said wall and roof panels consist essentially of compacted fibrous material covered with paper.

9. Multiple modular buildings as defined in claim 1, said buildings being clustered together in panel registered relation.

10. The multiple modular buildings of claim 9 wherein adjacent buildings have certain walls thereof extending in close parallel relation.

11. The modular building of claim 1 wherein the lower edge portions of the roof panels extend continuously in and along said grooves formed along the lengths of the support members to distribute the loading exerted by the roof sections along the lengths of the upper surfaces of the wall panels.

12. Multiple modular buildings located in clustered relation, comprising ($x_1$) each building including:

(a) four upright walls together forming an enclosure, each of the walls including a succession of upright panels extending in a common plane, successive panels of each wall having upright lateral edges which are joined together in edge-abutting relation at joints formed therebetween, only the said panels defining the said building four walls, certain of said panels joined together to form corners of the enclosure, (b) the walls panels having uppermost edges which extend horizontally in a common horizontal plane, there being horizontal elongated support members on the wall panels adjacent said uppermost edges, (c) a pyramid shaped roof extending over the enclosure and defined by four like roof sections spaced about a vertical axis intersecting a peak formed by a common intersection of the four roof sections, each section including at least two roof panels extending in a common plane inclined upwardly toward said peak, (d) said two roof panels of each section having:

(i) lower edge portions supported by said support members on the wall panels, and (ii) first lateral edge portions joined together in edge abutting relation and extending toward said peak, (e) and the said roof panels of adjacent sections having second lateral edge portions joined together in edge abutting relation to support the sections laterally above the level of a plane defined by the roof panel lower edge portions, said second lateral edge portions located along lines extending diagonally from said corners toward said peak, ($x_2$) the upright walls of at least two of the buildings being mounted to extend is close parallel relation, upright panels of the close together walls having the same modular width, at locations spaced from building corners.

($x_3$) adhesive mastic in said joints acting to bond successive wall panels together, ($x_4$) tape strips bonded to successive panels of each wall at and along said upright lateral edges thereof, at outer side surfaces of the panels adjacent said edges, and at inner side surfaces of the panels, thereby bridging said joints, ($x_5$) said tape strips comprising substantially the only joint overlapping interconnection of the panels, at and along the edges thereof.

($x_6$) successive roof panels also bonded together and connected together as are said successive wall panels, ($x_7$) said support members with said roof supported thereon providing a lateral stiffening means for restraining bowing of the tape and mastic interconnected wall panels.

13. The modular buildings of claim 12 including adhesive joining together said lateral edges of successive panels in each wall, in said edge abutting relation.

14. The modular buildings of claim 12 including adhesive joining together said first lateral edge portions of the two roof panels of each roof section, in said edge abutting relation.

15. The modular building of claim 12 including tape joining together said lateral edges of successive panels in each wall, in said edge abutting relation.

16. In the method of constructing multiple buildings located in clustered relation, each building including four upright walls together forming an enclosure, each of the walls including a succession of upright panels extending in a common plane, successive panels of each wall having upright lateral edges which are joined together in edge-abutting relation at joints formed therebetween, only the said panels defining the said building four walls, corners of the enclosure formed by corner panels, and intermediate panels located between the corner panels along each wall, and a roof extending over and supported by horizontal support members or the walls of the enclosure, the steps that include:

(a) providing all of said panels and said roof to consist of low strength fibrous material, and providing said intermediate panels to have uniform widths, the number of said intermediate panels selected to provide different size buildings, (b) and clustering the different size buildings to bring into opposed registration the intermediate panels at a side of one building with the intermediate panels at a side of another building, (c) and providing said roof with multiple edge to edge intermediate panels inclined toward a peak, (d) providing adhesive mastic in joints formed between said upright lateral edges of successive wall panels, (e) tape-connecting the successive panels of each wall at and along said upright lateral edges thereof by adhesively bonding tape to the outer surfaces of the panels adjacent said edges to bridge said joints, (f) and also tape-connecting the successive panels of each wall at and along said upright lateral edges thereof by adhesively bonding tape to the inner surfaces of the panels adjacent said edges to bridge said joints, (g) said tape-connecting providing the only joint overlapping interconnection of the wall panels, at and along said edges thereof, (h) said low-strength fibrous material being in compacted state, to a density of about 16 to 23 pounds per cubic foot, and a modulus of elasticity of about 17,500 to 21,500 psi, (i) and joining said support members to said walls of the enclosure and also joining said roof to the support members to laterally stiffen said building by restraining bowing of the tape and mastic interconnected wall panels.

17. The method of claim 16 including sizing said intermediate panels to have about four foot widths, said clustering carried out to stagger said side wall of one building relative to said side wall of another building.

18. The method of claim 16 including forming openings between the clustered buildings through said walls thereof by omitting certain of said intermediate panels.

19. The method of claim 17 including sizing said corner panels to have about two foot widths and joining the edges of tow corner panels at each corner of the building.

20. The method of claim 16 including joining the upright lateral edges of successive panels in edge abutting relation.

21. The method of claim 16 including joining the panels together so that only the said corner and intermediate panels define the entire four walls of the building.

22. Multiple buildings located in clustered relation, each building including four upright walls together forming an enclosure, each of the walls including a succession of upright panels extending in a common plane, successive panels of each wall having upright lateral edges which are joined together at joints formed therebetween, corners of the enclosure, formed by corner panels, and intermediate panels located between the corner panels along each wall, and a roof extending over the enclosure, and including:

(a) said intermediate panels of said buildings having uniform width, the numbers of said intermediate panels selected to provide different size buildings which are clustered, (b) the intermediate panels at a side wall of one building extending in opposed registration wit the intermediate panels at a side wall of another building clustered with said one building, (c) adhesive mastic in said joints acting to bond successive wall panels together.

(d) tape strips bonded to successive panels of each wall at and along said upright lateral edges thereof, at outer side surfaces of the panels adjacent said edges, and at inner side surfaces of the panels, thereby bridging said joints, (e) said tape strips comprising substantially the only joint overlapping interconnection of the panels, at and along the edges thereof, (f) horizontally elongated supports on the walls at upper edges thereof, the roof joined to said supports, (g) said supports and the roof thereon providing a lateral stiffening means for restraining bowing of the tape and mastic interconnected wall panels.

23. The buildings of claim 22 wherein said intermediate panels have about four foot widths, said side wall of one building staggered relative to said side wall of another building.

24. The buildings of claim 22 wherein openings are formed between the clustered buildings through said walls thereof, the openings being of panel width.

25. The buildings of claim 23 wherein said corner panels have about two foot widths, the edges of two corner panels at each corner of the building being joined together.

26. The buildings of claim 23 wherein the upright lateral edges of successive panels are joined in edge abutting relation.

27. The method of claim 22 wherein the panels are joined together so that only the said corner and intermediate panels define the entire four walls of the building.

* * * * *